144-39

10/22/85 XR SR 4,548,247

United States Patent [19]

Eklund

[11] Patent Number: 4,548,247

[45] Date of Patent: Oct. 22, 1985

[54] METHOD OF PROCESSING CURVED LOGS

[75] Inventor: Urban Eklund, Munkfors, Sweden

[73] Assignee: Kockums Industri AB, Soderhamn, Sweden

[21] Appl. No.: 556,948

[22] Filed: Dec. 1, 1983

[30] Foreign Application Priority Data

Dec. 9, 1982 [SE] Sweden ..... 8207023

[51] Int. Cl.[4] ..... B27B 1/00

[52] U.S. Cl. ..... 144/357; 83/71; 83/102.1; 83/367; 83/425.3; 144/39; 144/246 R

[58] Field of Search ..... 144/242 R, 242 E, 246 R, 144/246 F, 249 R, 249 A, 356, 357, 1 R, 39, 41; 83/71, 425 R, 425.2, 425.3, 409, 365, 367, 370, 371

[56] References Cited

U.S. PATENT DOCUMENTS

| | | | |
|---|---|---|---|
| 4,127,044 | 11/1978 | Kenyon | 144/249 A |
| 4,139,035 | 2/1979 | Bystedt et al. | 144/357 |
| 4,144,782 | 3/1979 | Lindstrom | 83/425 |
| 4,239,072 | 12/1980 | Merilainen | 144/357 |
| 4,373,563 | 2/1983 | Kenyon | 144/242 E |
| 4,440,203 | 4/1984 | Ostberg | 144/246 F |
| 4,449,557 | 5/1984 | Makela et al. | 144/357 |

*Primary Examiner*—W. D. Bray

*Attorney, Agent, or Firm*—Cushman, Darby & Cushman

[57] ABSTRACT

A crude curved log with an essentially circular cross-section is before a first machining cycle in a working machine fixed in a rotary condition where the longitudinal sectional plane comprising the maximum curvature is horizontal, and is then measured and processed along curved paths determined in a computer unit on the basis of the measured curvature. Thereafter the central block, thus obtained is processed, in a second cycle along paths having the same curvature as the first cycle by utilizing the same command signals as in the first cycle are used, possibly with a correction for changed lateral position of the block.

9 Claims, 3 Drawing Figures

METHOD OF PROCESSING CURVED LOGS

Figure 1:
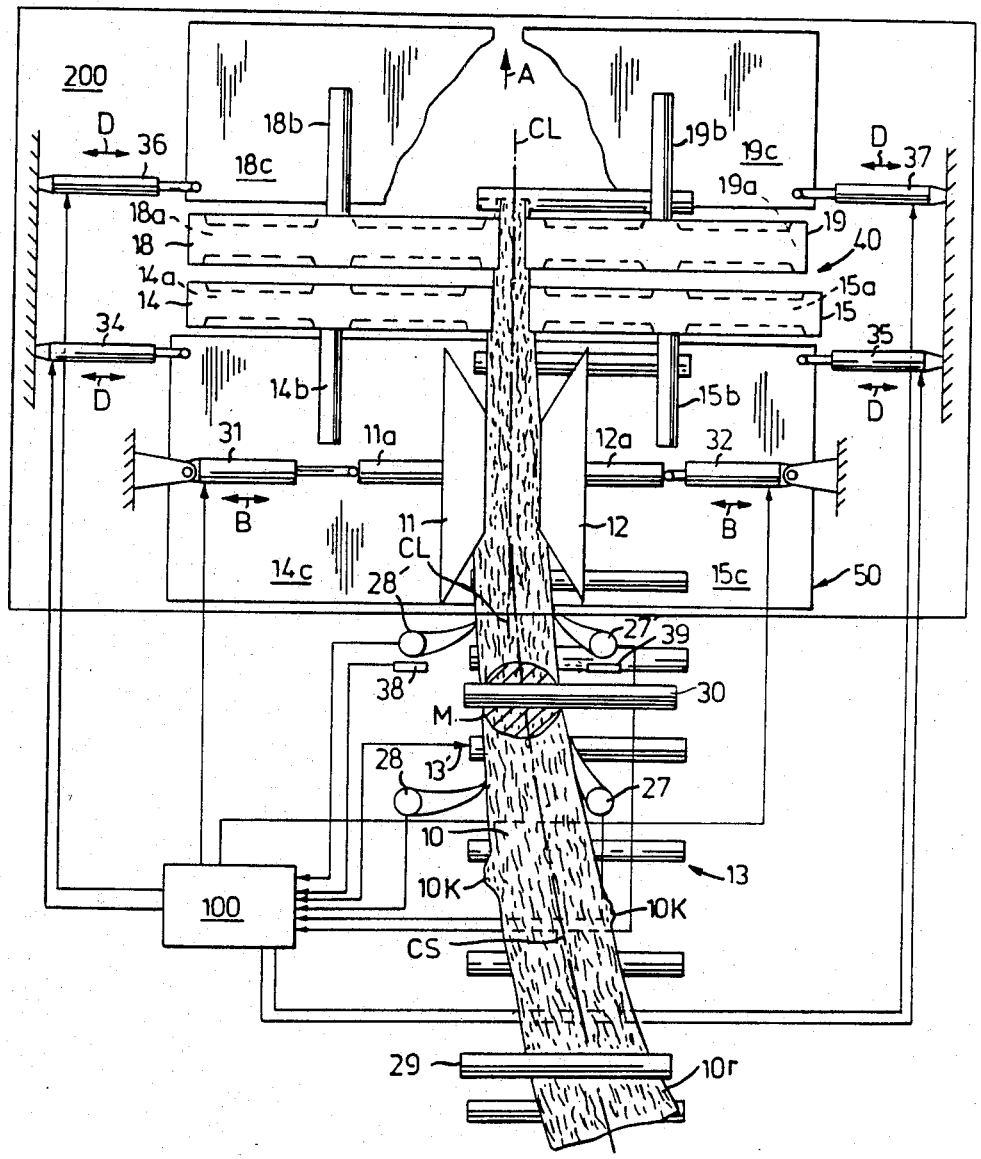

The invention relates to a method of processing curved logs. Such logs have in one longitudinal sectional plane a maximum curvature and consequently curved center line which has a maximum curvature in that plane. In the present description said longitudinal sectional plane is referred to as "plane of curvature". In addition, the terms "processing", "working" or "machining" are to be understood to mean separation by chip removal (such as cutting by saw) and/or reduction (removal of outer portions) by any known method (with the aid of saw blades or reducer heads).

According to methods known up to now, curved logs are oriented so that their plane of curvature is vertical when fed through a first working turn or machining operation (cycle) in a working machine (saw machine, reducer machine, or combined saw and reducer machine). The working machine is provided with settable or positionable tools (such as saw blades and/or reducer heads) and in this first machining cycle the logs are worked (i.e. reduced by sawing or by milling and/or cut by sawing) along straight paths or tracks. Orientation and processing of this kind is described e.g. in the U.S. Pat. No. 4,139,035. A so-called central yield or central block (one or two pieces of timber in the shape of a block), and possibly one or several side boards are obtained which are delimited by vertically extending, machined (sawn or milled) plane faces, and by horizontally extending, curved faces (generally wane faces) which conmect said plane faces one with another.

Before a second machining operation, all timber pieces obtained in the first operation are rotated through 90° so that the plane of curvature is disposed in a horizontal position. In order to obtain timber pieces with uniform thickness, the central yield has in this second working pass been machined (reduced by sawing or milling and/or cut by sawing) along curved paths (so called curved sawing). These curved working paths have been obtained in such a manner that at the latest before the second machining cycle the curvature of the piece of timber has been determined by scanning or measurement and fed into a computer unit where on the basis thereof command signals have been generated for setting means, which setting means were adapted to affect, during the second cycle, the relative position of the work piece and the tools (e.g. to laterally move the working tools).

In both prior art machining cycles, the log or block are fed through the respective working machine in a fixed rotary condition and moreover also in a fixed position. By "rotary condition" is understood, in this description, the angular position of a longitudinal sectional plane (e.g. the above mentioned plane of curvature), and by "position" is understood the position of the center line of the log or block in relation to the center line of the machine.

The result of the second machining cycle is at least one block, and mostly also at least one side board, which are limited by vertically extending, curved, machined faces and by horizontally extending, straight upper and lower faces or sides connecting the first named faces. As the pieces of timber dry, their curvature diminishes and at the end are pieces of timber (cants, planks and boards) obtained which essentially have all edges and faces straight. This, however, is not the case with side boards with curved wanes, obtained in the first machining cycle. It certainly is technically feasible to remove curved wanes by curved sawing, but there is generally no demand for boards having curved side faces. It is therefore necessary to edge these boards, with greater or smaller waste, in the ordinary manner along straight working paths and possibly produce several non-alined short pieces (see U.S. Pat. No. 4,239,072, FIGS. 4 and 5). Such cutting, however, is performed across the grain. The boards warp when drying, and are also less resistant.

It is an object of the present invention to provide a method and a device which simplifies processing of curved logs by eliminating the need to change the rotary condition through 90° between the first and the second machining cycle and allowing to obtain also in the first cycle products, inclusive of possible side boards, limited by upper and lower faces which are essentially straight, so that the side boards may be edged along straight paths with the least possible waste of material. Also a further drawback is eliminated by the invention in that the curved log in the first machining cycle no longer rests instably on its support (conveyor) as is the case when the plane of curvature is vertical, and the log in dependence of its orientation rests on the support only with the two ends, or only with its central portion. Also special positioning means for setting the log on a conveyor in the first machining cycle can be eliminated, because the log adapts automatically the rotary condition according to the present invention when not affected by forces other than gravitation.

Figure 3:
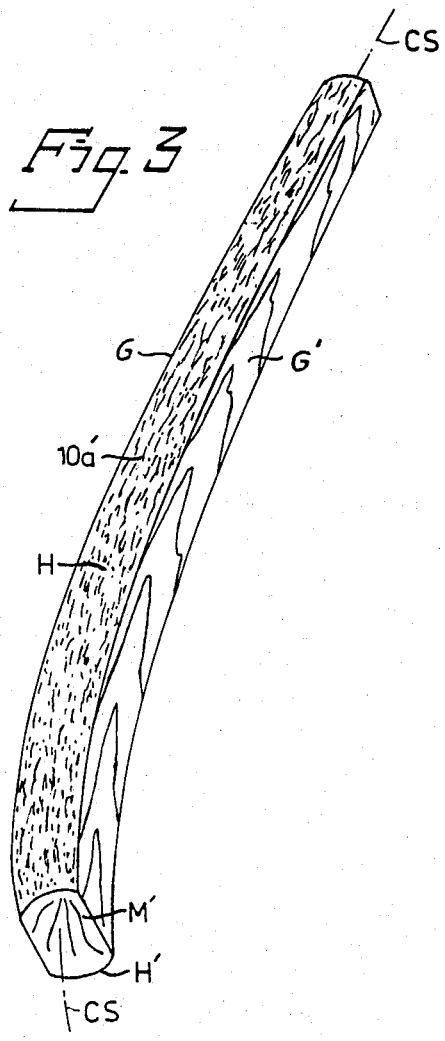

According to the invention, the first and second cycle may be performed either on two different machines, installed e.g. one behind the other, or on one and the same machine. The characterizing features of the invention are evident from the enclosed patent claims. The invention shall now be explained more in detail with the aid of the attached diagrammatic drawings referring to exemplary embodiments and in which FIG. 1 shows in plan view a device working according to the invention, FIG. 2 shows a plan view a curved log after it has in a first machining cycle passed through the device of FIG. 1, and FIG. 3 shows in a perspective view the central block of FIG. 2.

Figure 2:
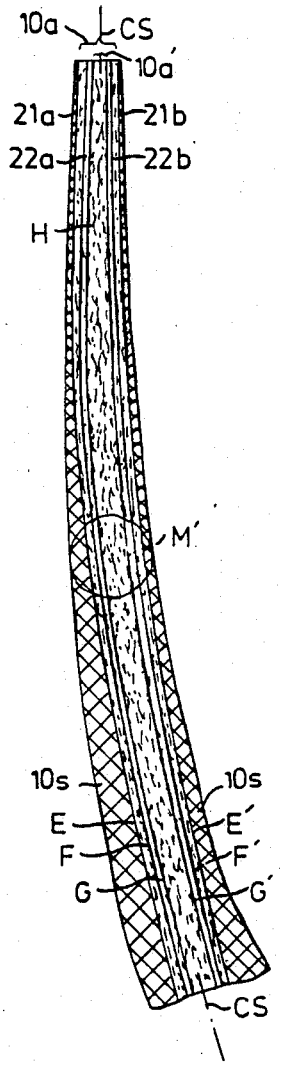

According to FIG. 1, a curved crude (unmachined) log 10, having an essentially circular cross-section M and a curved center line CS, is forwarded on a longitudinal conveyor 13. Conveyor 13 is shown in the drawing as consisting of a plurality of driven rollers, but it also can be of any other arbitrary type. The plane of curvature of the log which includes its curved center line extends horizontally, i.e. parallel with the plane of the drawing, and the log is securely fixed in this rotary condition by holder rollers 29 and 30 engaging the log from above. At the same time, due to the holder roller, the position of the log relative to the adjacent working machine 200 is fixed, i.e. the center line CS of the log and the center line CL of the machine maintain their relative position unchanged as the log is conveyed. The width of the conveyor 13 and the length of the holder rollers 29, 30 are selected so that even strongly curved logs are laterally covered. The position of the log on the conveyor is stable, because the log rests along its entire length on the conveyor and cannot be overturned even by the strong pressure of the holder rollers. It will be appreciated that in contradistinction e.g. to the procedure described in the said U.S. Pat. No. 4,139,035, no particular steps are necessary to have the log on the conveyor oriented in the desired position with the plane of curvature horizontal, because this is the position which a curved log automatically adopts when not affected by outer forces, or more correctly, when affected only by gravitation.

The log is sensed as to its shape in plan view, where the greatest curvature shows, by two pairs of mechanical sensors defined by trailer shoes 27, 28, 27', 28' (or by any other known sensing device, e.g. an optical one), and the result of measurement is fed into the computer unit 100 where a so called "theoretic value of curvature" is computed therefrom, i.e. the value of the actual curvature disregarding accidental irregularities such as knots 10*k*, and expressed e.g. in terms of the radius of a circular arc which closest coincides with the center line CS of the log. By a sensor 13' which monitors the movement of the conveyor 13 and thereby also the forward feed of log 10 in the sense of arrow A, e.g. a pulse generator or some other sensor of known type, a signal is generated which is also fed-in into the computer unit 100 to enable determination of the curvature value in combination with signals obtained from the sensors 27, 28 and 27', 28'. An optical barrier, comprising a radiation emitter 39 and a receiver 38 connected to the computer unit 100, is provided to start and finish the measuring process.

The working machine 200 is a combined reducing and sawing machine. The reducer part 50 thereof comprises two reducer heads 11, 12 which are driven in rotation by electric motors (not shown) and which are positionable in the sense of the arrows B, i.e. transversly to the feed direction, with the aid of setting means, 31, 32, e.g. stationarily anchored cylinder-piston-assemblies, driven by a pressure medium and operable by remote control, and which affect the shafts 11*a*, 12*a* of the reducer heads 11, 12 and are electrically connected to the computer unit.

The saw part comprises two pairs of band saw machines of which in the drawing for clarity are shown only the band saws 14, 15, 18, 19 running over pulleys 14*a*, 15*a*, 18*a*, 19*a*carried by shafts 14*b*, 15*b*, 18*b*, 19*b* respectively. These shafts are in knowm manner mounted in machine stands (not shown) erected on base plates 14*c*, 15*c*, 18*c*, 19*c*, which are laterally movable in the sense of arrows D. For the lateral movement, the base plates are connected to stationarily anchored positioning means 34 35, 36 and 37 which also can be defined by cylinder-piston-assemblies driven by a pressure medium, operable by remote control and electrically connected to the computer unit 100. The working machine 200 has a center line CL which is common to all working tools (saw blades).

Up to now, reducer heads have been positioned, when processing crude logs, only to set the mutual distance of the heads for various diameters of the logs, either when a narrower logenters into the reducer part after a thicker log, or vice versa, or at a moment during processing (Applicant's Swedish patent application 8009156-4) when the diameter of the log has become so great that at least one additional side board may be obtained. The last mentioned method is described in detail in the German Offenlegungsschrift No. 31 51 188. Lateral movement of the saw blades has been used in processing crude logs for posting by remote control. Posting is understood to mean setting the saw blades in positions which ensure that pieces of timber having desired thickness are obtained. This setting has been done in one go before the start of the operation, and not continuously during the whole time the log is passing through the machine.

According to the present invention, command signals which have been generated in the computer unit 100 on the basis of the computed theoretical value of curvature are fed into the setting means 31, 32, 34 to 37 already in the first machining cycle, shown in FIG. 1, i.e. during the first passaage of the log through the working machine. Consequently, the individual working tools 11, 12, 14, 15, 18, 19 occupy at any moment such positions that processing takes places along paths such as represented by the lines E, E',F, F', G, G' in FIG. 2 which are curved in accordance with the theoretical value of curvature and which in most cases differ from the start positions of the tools (by "start position" is understood a position of a pair of tools which is symmetrical with respect to the center line CL). The command signals are fed out of the computer unit 100 and fed-in into the setting means with a time delay corresponding to the distance, more correctly to the transport time, between the sensors 27, 27', 28, 28' and the respective tool. The delay is determined in the computer unit 100 preferably with the aid of signals received from the pulse generator 13' or a similar means.

The result of such processing is shown in FIGS. 2 and 3. The reducer heads 11 and 12 have removed the zones 10*s* which arecross-hatched in FIG. 2, so that a block 10*a* has been obtained which at the sides is limited by machined, vertically extending faces E, E' which are curved according to the theoretical value of curvature and which are interconnected by horizontally extending, essentially straight upper and lower wane faces H, H', curved only in the cross-sectional direction, as is evident from the cross-section M'. The saw blades 14, 15, 18, 19 have from this block 10*a* separated side boards 21*a*, 21*b*, 22*a*, 22*b* so that block 10*a* has been reduced to a central yield block 10*a'* which is shown in a perspective view in FIG. 3. Also the side boards and the block 10*a'* are limited by vertically extending machined faces E, E', F, F' and G, G' which are connected by essentially straight upper and lower wane faces. All said side boards 21*a*, 21*b*, 22*a*, 22*b* have thus, after the first machining cycle according to the invention, principally the same appearance as the block 10*a'* in FIG. 3 (with the exception of being of smaller thickness).

The side boards are thereafter processed, in a rotary condition turned through 90°, in an edging plant along stright working paths just as boards obtained from straight logs. Up to now, this was possible with boards obtained in a first machining cycle from curved logs only to the price of increased waste, as stated above, because they had curved wanes.

The central yield block 10*a'* is in the second machining cycle processed in the same rotary condition, and along the same curved working paths, as in the first cycle. This second processing takes place in order to further divide the block 10*a'* by one or several saw blades in two more cants, planks or boards. All these pieces of timber obtained in the second machining cycle will again show the same fundamental shape as in FIG. 3. This shapeis after the second machining cycle, but only then, conventional for products obtained by curved sawing.

Final processing is thereafter performed, in a third machining cycle, e.g. in conventional manner by all pieces of timber being turned through 90° and edged along straight paths as described above in connection with the side boards obtained in the first cycle according to the present invention.

The second machining cycle must not take place too long after the first one, as it must be performed before the curvature of the pieces obtained in the first cycle had opportunity to change due to drying, because only then is the same theoretical value of curvature as in the first cycle applicable, and consequently the same command signals as in the first cycle can be used in order to obtain pieces of timber with even thickness.

The second machining cycle may be performed either on the same working machine as the first one, or on another machine, e.g. following the first machine. The command signals may be triggered in the second cycle e.g. with the aid of a position indicating means which senses the movement of the conveyor (e.g. a pulse generator connected to the conveyor) and/or the arrival of the block at the input end of the machine, or by a per-set electronic time delay means.

According to a first alternative, the block 10*a*′ is brought back to the start position of log 10 shown in FIG. 1, and is deposited on the conveyor 13 in the same rotary condition as was earlier the case with log 10. The plan view shape of block 10*a*′ is again measured by the sensors 27 etc., but this time not to establish this shape, because it is already known as it now exactly corresponds to the theoretical value of curvature, but in order to determine possible and probable changes of the relative position of the center lines CS and CL. If such a change of position which respect to the position of the crude log is found, (which generally occurs), block 10*a*′ may either first be reset into the same position as the crude log 10 had, and the setting means in the working machine 200 (where in the meantime the tools have been brought into desired new posting positions) are then fed with the same command signals as in the first machining cycle, or the block 10*a*′ may maintain its position and then are from the computer unit 100 fed out the same command signals as in the first cycle as far as the curvature value is concerned, but corrected for the changed position of the block 10*a*′ on the conveyor 13, so that the curved working paths will have the same position relative to the center line of the block as they had relative to the center line of the log.

When the second machining cycle is performed on another working machine (e.g. on a machine corresponding to the machine 200 or at least to the saw part 40 thereof), then this other machine may be mounted along the same center line as the first one. Block 10*a*′ is then fed forward to the other machine on the same conveyor 13, fixed by further holder rollers, and the setting means in the other machine are fed by the same command signals as in the first cycle, this time without any correction.

If the other machine is located in such a way, e.g. sideward from the first machine, that the block 10*a*′ cannot maintain its position on the conveyor before it reaches the other machine, the same two alternative procedures may be applied as described above for the case of the second processing being performed in the same machine as the first one.

It will be realised that processing in the second machining cycle is according to the invention always performed along paths having exactly the same curvature as in the first cycle, but possibly another inclination relative to the center line of the working machine if the block itself has another inclination ("position" in the terminology of the present description) relative to the center line of the machine than what the crude log had.

In the Swedish patent application No. 8009156-4, mentioned above, there is described a method and a device for treating tapering logs which have a considerable natural conicity. The data information concerning the shape of the log, which according to the present invention is established in the computer unit 100, can at the same time be used for positioning the reducer heads according to said patent application so that the yield possibly may be increased by one or more extra side boards even in curved logs with marked conicity.

Although the change of the relative lateral position of the log and the working tools, which is necessary for curved sawing in the first machining cycle, has been in the above described example achieved by a lateral movement of the working tools, it may be also performed, and particularly when all working tools are mounted at one location along the center line CL, by the log 10, or at least its root end 10*r* (FIG. 1), being moved laterally in accordance with the theoretical value of curvature, e.g. in a device according to Applicant's Swedish patent application No. 7901674-7.

When in the present description a lateral move of the working tools is mentioned, then a lateral motion of the operative part of the respective working tool relative to the stationary parts of the working machine is actually meant. In Applicant's Swedish patent No. 398 609 there is described a sawing method and band saw machines, where the operative part of a saw blade is by movable blade guides laterally moved in order to compensate undesirable side shifting into a so called equilibrium position. According to the present invention, such movable blade guides can be connected to the positioning means which are controlled by the computer unit and be moved instead of moving the entire stand of a band saw machine or the base plate on which the sawing machine is mounted.

I claim:

1. A method of processing a log which in a plane of curvature has a curved center line with the use of apparatus including a computer unit where command signals are generated for operating positioning means by which the relative position of the log with respect to working tools of a working machine can be changed, said method comprising the steps of positioning a crude log ith an essentially circular cross-section in a rotary condition where its plane of curvature is horizontal, measuring the plan view hape of the positioned crude log, transmitting the measurements to the computer unit so as to generate command signals which define a theoretical value of curvature corresponding to the measurements freed from accidental irregularities caused by knots and the like, feeding the log with its plane of curvature horizontal through a working machine and utilizing the command signals to effect a first machining cycle which processes the log along curved working paths defined by said theoretical value of curvature so as to obtain at least a central yield block defined by worked, vertically extending faces curved in accordance with the said theoretical value of curvature, and by horizontally extending upper and lower faces extending essentially straight in the direction of the center line, and feeding said block through a working machine for further division without any change in the rotary condition and before the worked faces established in the first cycle appreciably could have changed their shape due to drying and utilizing the same command signals to effect a second machining cycle which processes the block along working paths having the same theoretical value of curvature.

2. The method of claim 1 wherein the block is processed in the second cycle in the same position a the log was processed in the first cycle and the command signals are fed out of said computer unit without any correction.

3. The method of claim 1 wherein the block is processed in the second cycle in another position than in which the log was processed in the first cycle and the command signals are fed out of said computer unit with a correction for the change of position.

4. The method of claim 1 wherein the block is processed in the second cycle in the same working machine as the log was processed in the first cycle.

5. The method of claim 2 wherein the block is processed in the second cycle in another machine than where the log was processed in the first cycle and the block is in unaltered position conveyed between the machines for the first and the second procesing cycles.

6. The method of claim 1 wherein the output of the command signals in the second cycle is triggered by a pre-set time delay means.

7. The method of claim 1 wherein the output of the command signals in the second cycle is triggered by a position indicator means such as a pulse generator connected to the feeding means for the machine.

8. The method of claim 1 wherein the working tools of the working machine are moved relative to the log to achieve said curved paths.

9. The method of claim 1 wherein the log is moved relative to the working tools of the working machine to achieve said curved paths.

* * * * *